US007143491B2

(12) United States Patent
Wood

(10) Patent No.: US 7,143,491 B2
(45) Date of Patent: Dec. 5, 2006

(54) DOOR HINGE PIN REMOVAL TOOL

(76) Inventor: Samuel T. Wood, 2704 Cedar Dr., Riva, MD (US) 21140

( * ) Notice: Subject to any disclaimer, the term of this patent is extended or adjusted under 35 U.S.C. 154(b) by 0 days.

(21) Appl. No.: 11/010,396

(22) Filed: Dec. 14, 2004

(65) Prior Publication Data

US 2006/0123611 A1 Jun. 15, 2006

(51) Int. Cl.
*B25B 27/14* (2006.01)

(52) U.S. Cl. ..... 29/275; 29/278; 81/3.55; 81/3.27

(58) Field of Classification Search ..... 29/275, 29/278, 270, 276, 254; 254/131, 25; 81/3.55, 81/3.27
See application file for complete search history.

(56) References Cited

U.S. PATENT DOCUMENTS

| | | | | |
|---|---|---|---|---|
| 441,979 | A | 12/1890 | Rohrbach | |
| D55,792 | S | 7/1920 | Hudgins | |
| 1,355,174 | A | 10/1920 | Shepard | |
| D206,516 | S | 12/1966 | McKee | |
| 3,602,969 | A | 9/1971 | Provost | |
| 4,183,133 | A | 1/1980 | Abbott | |
| 4,188,701 | A | 2/1980 | Ludwig | |
| 4,597,123 | A | 7/1986 | Cobe, Jr. | |
| 5,303,619 | A * | 4/1994 | Cole, Sr. | 81/180.1 |
| D347,370 | S * | 5/1994 | Runevitch | D8/21 |
| D350,270 | S | 9/1994 | Jensen | |
| 5,435,030 | A * | 7/1995 | Phillips | 7/138 |
| 5,875,535 | A * | 3/1999 | Canoy | 29/275 |
| 5,896,607 | A | 4/1999 | Hagen | |
| D410,178 | S * | 5/1999 | Clayson | D8/16 |
| D419,848 | S | 2/2000 | Kirby | |
| D420,261 | S | 2/2000 | Carter, Jr. | |
| D439,490 | S | 3/2001 | Bagley | |
| 6,298,512 | B1 | 10/2001 | Hagen | |
| 6,351,881 | B1 * | 3/2002 | Peckich et al. | 29/275 |
| 6,409,152 | B1 | 6/2002 | Bagley | |

* cited by examiner

*Primary Examiner*—Lee D. Wilson
(74) *Attorney, Agent, or Firm*—Berenato, White & Stavish, LLC

(57) ABSTRACT

A multifunction tool that allows a user to remove hinge pins and adjust hinges during the installation and removal of hinged doors. In the preferred embodiment, the tool has a hinge pin bit and an anvil extending perpendicularly from opposite sides of the first end of the tool. The second end of the tool includes a slot extending along the tool's centerline. In an alternate embodiment, the tool incorporates an anvil extending from each side of the tool, and a hinge pin bit extending from each side of the tool. The hinge pin bits have different sizes so that the tool can be used on door hinges with different size hinge pins.

20 Claims, 8 Drawing Sheets

DOOR HINGE PIN REMOVAL TOOL

FIELD OF THE INVENTION

The invention relates to a multi-function hand tool used during the installation and removal of hinged doors in order to remove the pintle from a door hinge.

BACKGROUND OF THE INVENTION

Many different techniques and tools may be used for removing door hinge pins. The most common method involves using the head of a screwdriver to force the hinge pin upwardly, and a pair of pliers to grasp the head of the pin and extract the pin from the knuckle elements of the door hinge. While this method is simple, it requires at least three separate tools; namely, a hammer, a screwdriver and pliers. Also, the head of the screwdriver may be damaged so that it is no longer usable to drive screws. Additionally the use of a screwdriver can also result in damaged woodwork if the head of the screwdriver skips off the hinge pin during the hinge removal process. Additionally, due the awkward angle at which the screwdriver is held, the user may strike his or her hand with the hammer when attempting to strike the screwdriver.

The prior art also includes various specialty tools for the removal of door hinge pins. However, these tool are generally overly complex and therefore more expensive to produce than the current invention, or overly simple and consequently less versatile than the current invention.

The need exists for an effective and efficient tool that allows a user to remove hinge pins and adjust door hinges easily and conveniently. The current invention is an inexpensive multifunction tool that provides the user with the means to perform a variety of basic functions associated with door installation and removal.

SUMMARY OF THE INVENTION

The current invention has multiple advantages over the pliers-and-screwdriver process described above. The most apparent advantage is that the invention allows a user to remove a door hinge pin with two tools; namely, a hammer and the tool of the invention. The elongated design of the invention allows a user to reach tight corner areas and decreases the tendency of a user to angle the head portion of the tool during the hinge removal process, which decreases the chance that the tool will skip off the hinge pin and damage the surrounding woodwork. Additionally, the pry-bar design of the tool allows a user to fully extract the pintle or hinge pin once it has been broken free from the hinge plates. Similarly, during the door installation process, the bit portion of the current invention allows a user to align the holes in the separate hinge knuckles before the door is lifted in position and the pin is inserted. This allows the user to confirm that the hinge pin will slide all the way into both hinges before the door is moved into place.

The present invention comprises a hinge pin removal and adjustment tool. The tool has a body with a planar first side and an oppositely disposed planar second side. The tool also has a first end and an oppositely disposed second end. An elongated cylindrical anvil with a planar striking surface projects perpendicularly from the first side of the tool. A hinge pin bit extends perpendicularly from the second side of the tool. The hinge pin bit is located preferably coaxially with the anvil. A slot extends through the body of the tool from the first side to the second side of the tool and from the first end of the tool towards the second end of the tool. Striking the planar anvil striking surface causes the hinge pin bit to impart force to a hinge pin for dislodging the hinge pin from a door hinge.

The present invention also comprises a hinge pin removal and adjustment tool that includes two hinge pin bits. The tool has a body with a planar first side and an oppositely disposed planar second side. The tool also has a first end and an oppositely disposed second end. A first elongated anvil and a first hinge pin bit extend perpendicularly from the first side of the tool. The first hinge pin bit has a length that is at least the length of the first anvil. A second elongated anvil projects perpendicularly to the second side of the tool body. The second anvil is coaxially aligned with the first anvil. A second hinge pin bit also extends perpendicularly from the second side and is coaxially aligned with the first hinge pin bit. The second hinge pin bit has a diameter less than the diameter of the first hinge pin bit.

DETAILED DESCRIPTION OF THE INVENTION

Figure 1:
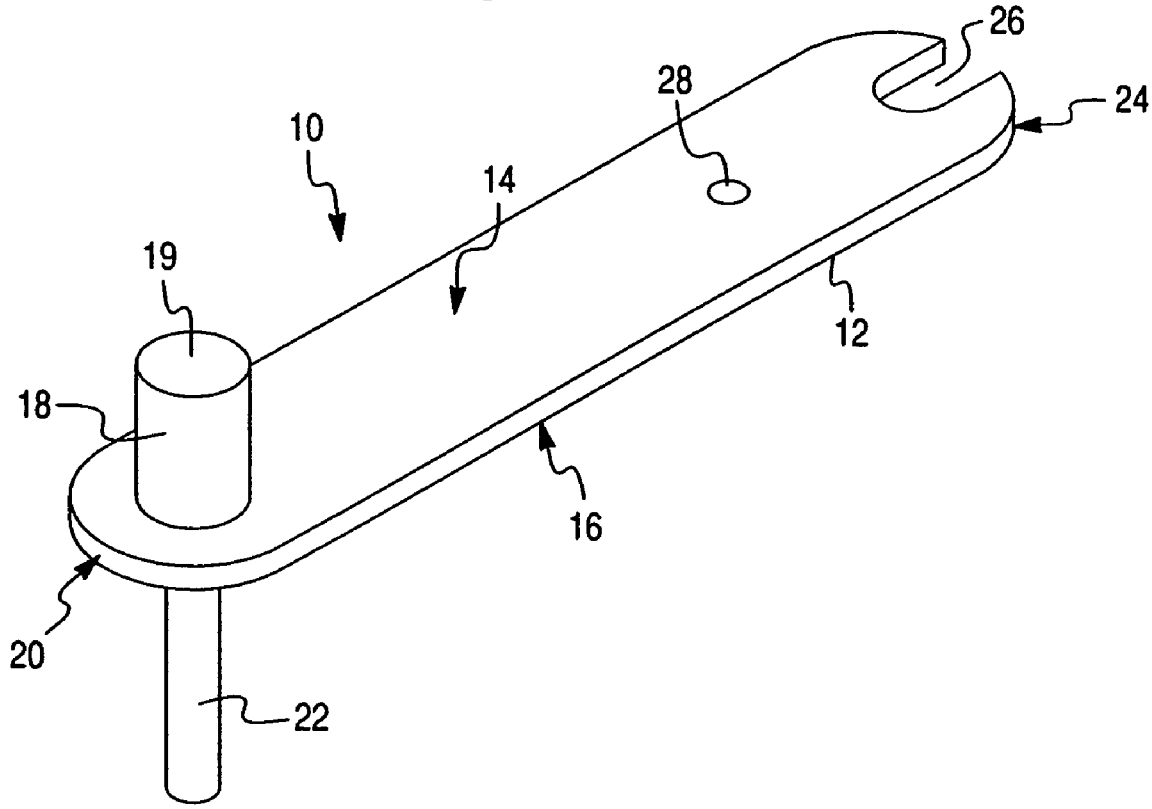
FIG. 1 is a perspective view of a first embodiment of the invention.
Figure 2:
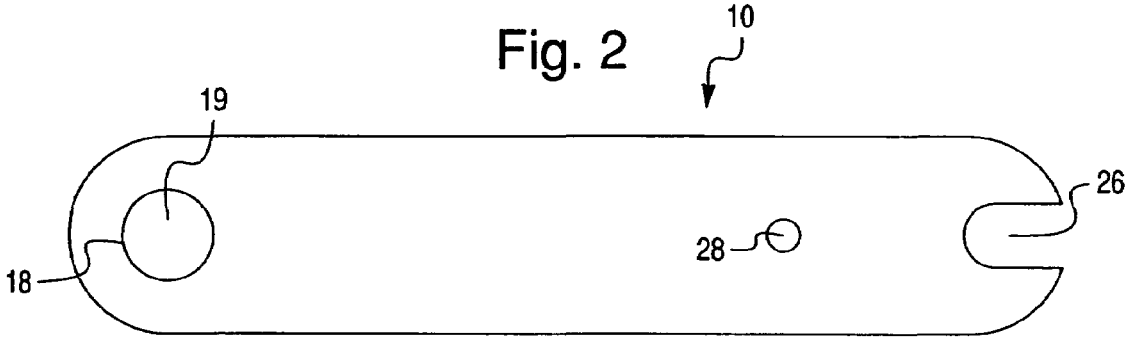
FIG. 2 is a top plan view of the first embodiment.
Figure 3:
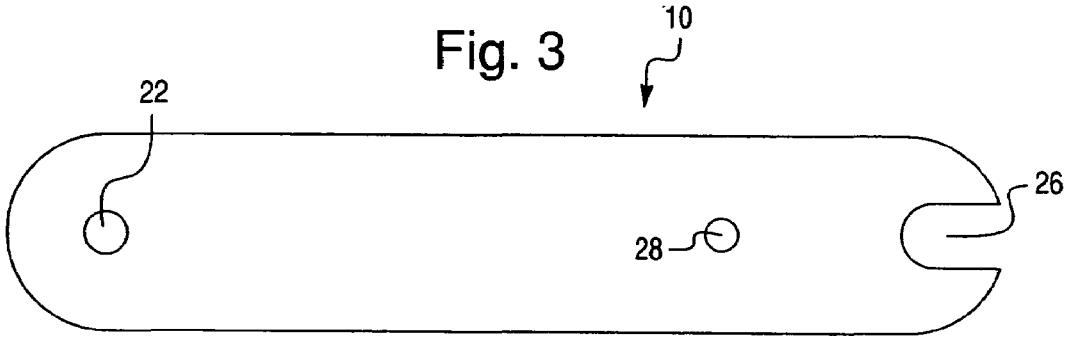
FIG. 3 is a bottom plan view of the first embodiment.
Figure 4:
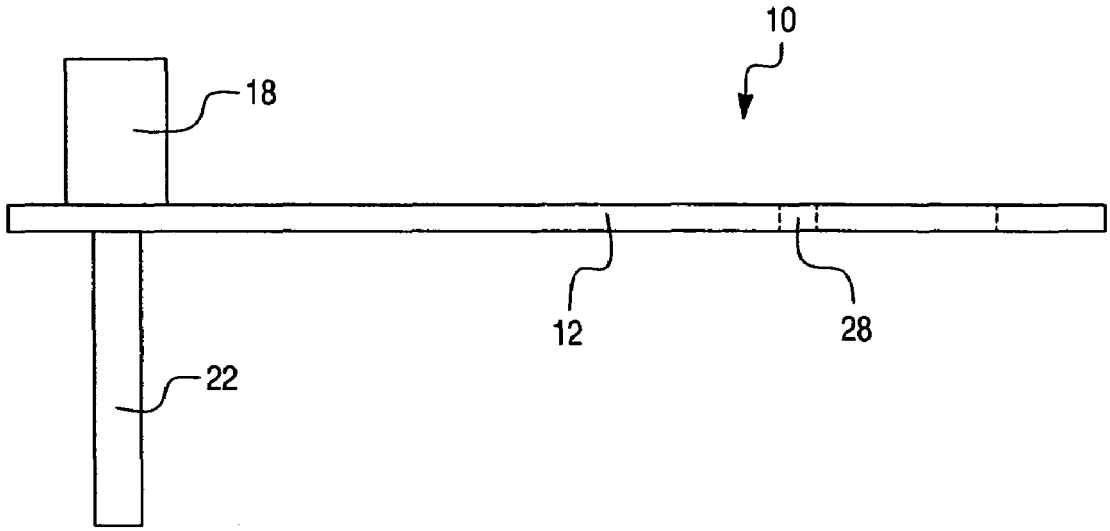
FIG. 4 is a side elevational view of the first embodiment with portions shown in phantom.
Figure 5:
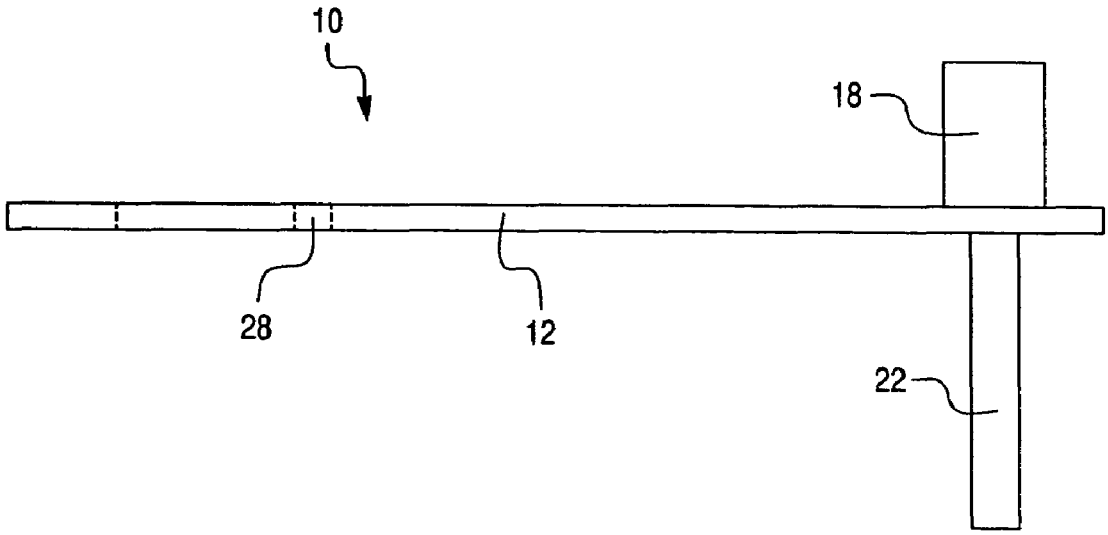
FIG. 5 is a side elevational view of the first embodiment with portions shown in phantom.
Figure 6:
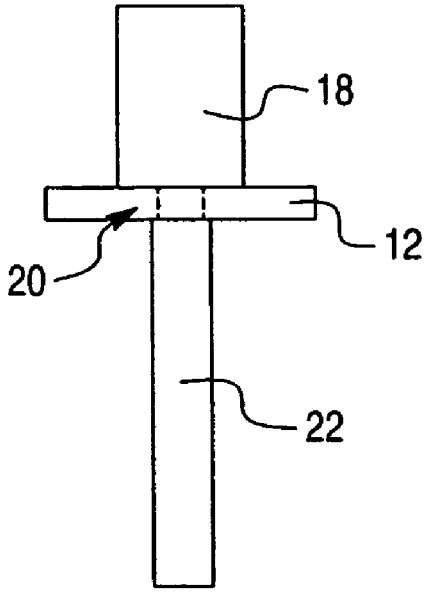
FIG. 6 is an elevational view of the first embodiment with portions shown in phantom.
Figure 7:
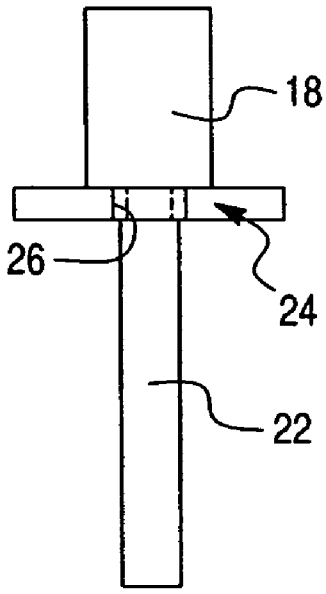
FIG. 7 is an elevational view of the first embodiment with portions shown in phantom.
Figure 8:
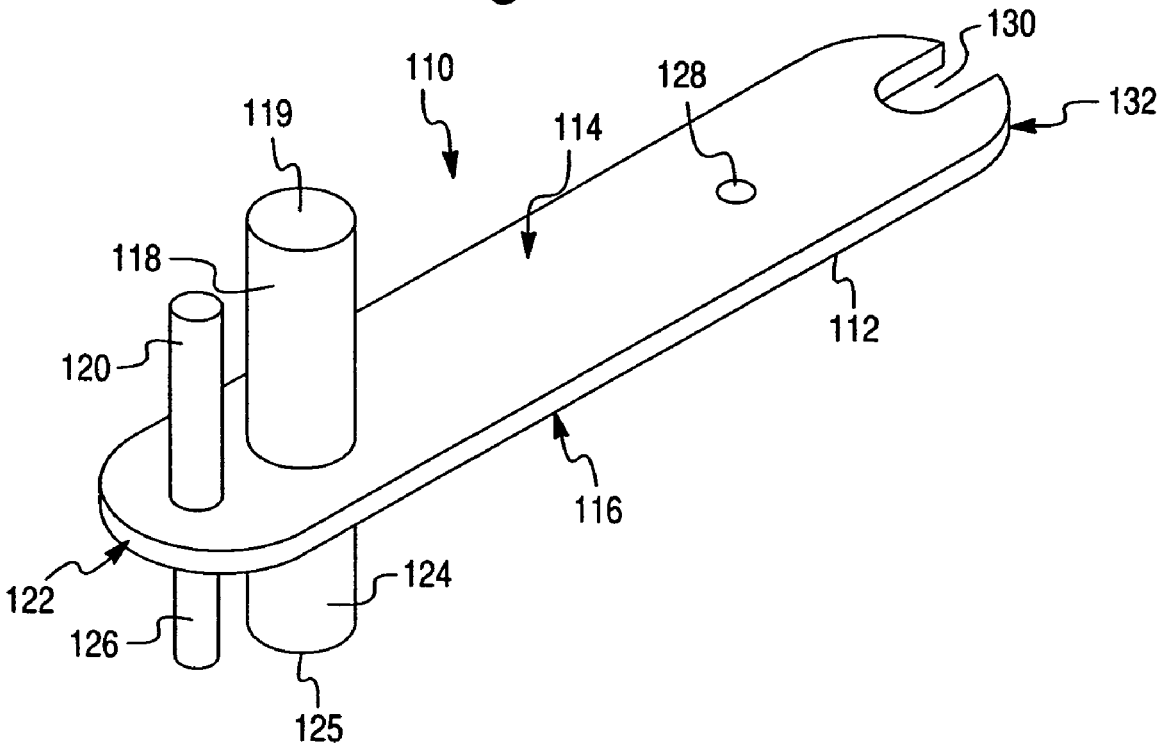
FIG. 8 is a top plan view of a second embodiment of the invention.
Figure 9:
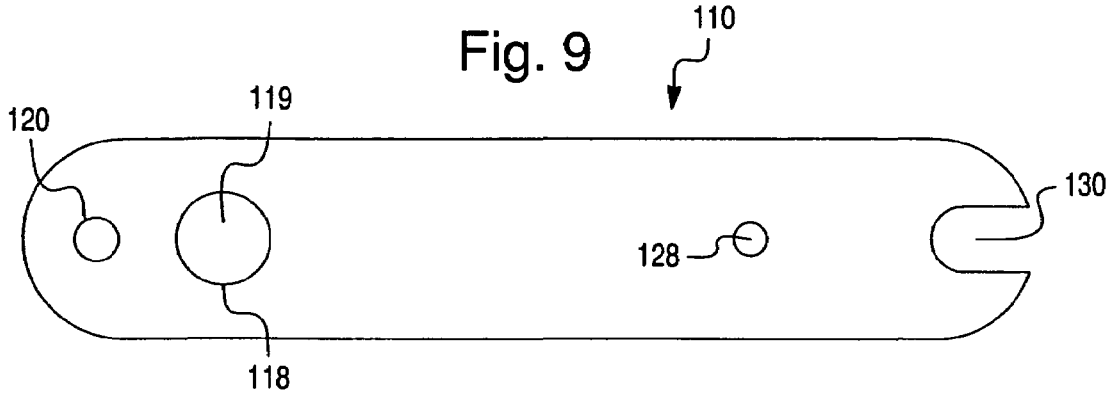
FIG. 9 is a top plan view of the alternative embodiment.
Figure 10:
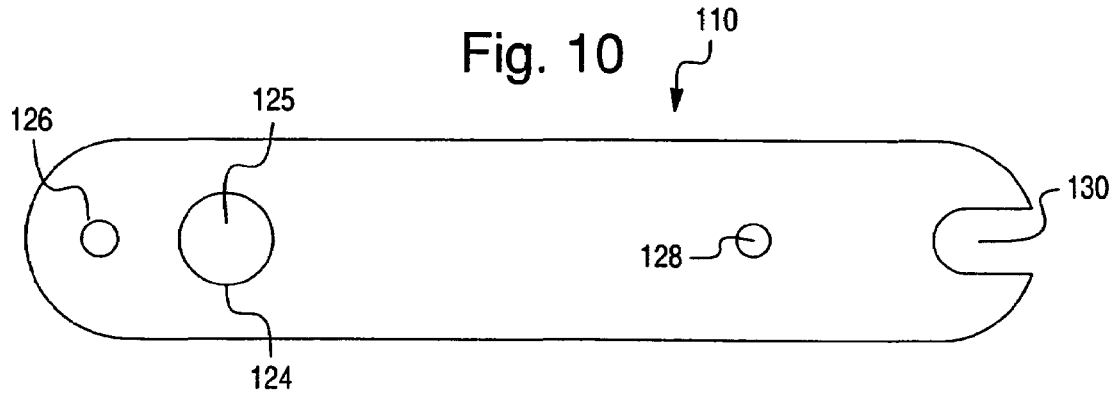
FIG. 10 is a bottom plan view of the second embodiment.

As best shown in FIGS. 1–7, a first embodiment of the invention comprises a tool 10 with an elongated body 12 having planar upper 14 and lower 16 sides. An elongated cylindrical anvil 18 with a planar striking surface 19 extends from the upper side 14 of tool 10 adjacent to first end 20 of the tool 10. A hinge pin bit 22 extends from the lower side 16 of the tool 10. Preferably, the anvil 18 is coaxially aligned with the bit 22, although it is merely necessary that the anvil 18 and hinge pin bit 22 extend in parallel in order to effect efficient transfer of force applied to anvil 18. The second end 24 of the tool 10 includes a hinge pin extractor slot 26 and a utility aperture 28. The slot 26 may be used to pry out and remove a pintle or hinge pin once the hinge pin bit 22 dislodges the hinge pin from the hinge. The utility aperture 28 can be used to suspend the tool 10 from a support, or as a connection point for a belt clip or carrying lanyard. Ends 24 and 20 are rounded in order to be able to allow the tool to access tight areas that sometimes are found when removing a pintle, such as when a door is adjacent a perpendicular wall.

The hinge pin bit 22 has a length exceeding the length of the anvil 18, whereas the anvil 18 has a diameter exceeding the diameter of hinge pin bit 22. Preferably the hinge pin bit 22 has a diameter somewhat less than the diameter of a standard pintle opening, such as 3/16 inch, in order to permit the hinge pin bit 22 to engage the pintle and be moved longitudinally through the openings in the hinge plate. The dimensions and shape of the anvil 18 and hinge pin bit 22 may be altered depending upon the needs of a user. For example, the anvil 18 may also be square, rectangular, triangular, etc. The slot 16 preferably has a rounded internal end to conform to a pintle and has a width less than the diameter of anvil 18 but greater than the diameter of hinge pin bit 22.

The body 12 of the tool 10 has an elongate shape. The tool 10 is comprised of tempered and/or cold rolled steel. However, as described above with regard to other tool 10 components, the dimensions of the body 12 may vary as required, and the tool 10 may be comprised of any rigid material including other metals, plastic, fiberglass, composites and the like. Similarly, the hinge pin bit 22 and anvil 18 may be comprised of a first material, such as a metal, and the body may be comprised of a second material, such as a plastic. Further, one or all of the components may also be comprised of a first material encased in a second material, such as a metal encased in a plastic. Other construction material configurations should also be considered within the scope of the invention.

I prefer that the striking surface 19 be planar or flat in order to minimize the possibility of the hammer striking the anvil 18 and bouncing so as to engage the door, doorframe, or like adjacent component. The hammer typically will have a flat striking surface, with the result that two flat or planar surfaces, one from the hammer and one from the anvil 18, will engage in order to cause force to be applied to hinge pin bit 22 and ultimately to the pintle for dislodging the pintle. Moreover, maximum force transfer occurs when two flat surfaces engage, rather than one being flat and the other being contoured.

Preferably the anvil 18 and hinge pin bit 22 are secured to body 12 by welding, brazing or the like. I prefer that the anvil 18 and hinge pin bit 22 be positioned intermediate opposite side edges of tool 10, so that the tool 10 has sufficient width to be held and manipulated during use.

As best shown in FIGS. 1–7, in operation, a user positions the hinge pin bit 22 in longitudinal alignment with a door hinge pin. If the hinge pin cannot be removed by directly manually applying pressure to the hinge pin with the tool 10, a hammer or other blunt object is used to strike the anvil 18 on the planar striking surface 19. The force from the hammer is communicated through the anvil 18 to the hinge pin bit 22. The hinge pin bit 22 forces the door hinge pin to move, usually upwardly, within the door hinge knuckles. Once the head of the pintle has been sufficiently displaced from the hinge, the user then positions the head of the hinge pin within the channel 26 at the second end 24 of the tool 10, and applies pressure to force the hinge pin out of the knuckles of the door hinge. The tool may also be used to bend and align the hinge pin knuckles, as required.

As best shown in FIGS. 8–14, in an alternate embodiment, the tool 110 is comprised of an elongated body 112 with planar upper 114 and lower 116 sides. A first elongated cylindrical anvil 118 and a first hinge pin bit 120 extend from the upper side 114 of the tool 110 at the first end 122 of the tool 110. A second anvil 124 and second hinge pin bit 126 extend from the lower side 116 of the tool 110. The first anvil 118 is coaxially aligned with the second anvil 124, and the first hinge pin bit 120 is coaxially aligned with the second hinge pin bit 126. The alternate embodiment also includes a utility aperture 128 for carrying or suspending the tool 110, and a hinge pin extractor slot 130 for grasping the hinge pin head and extracting the hinge pin.

Figure 11:
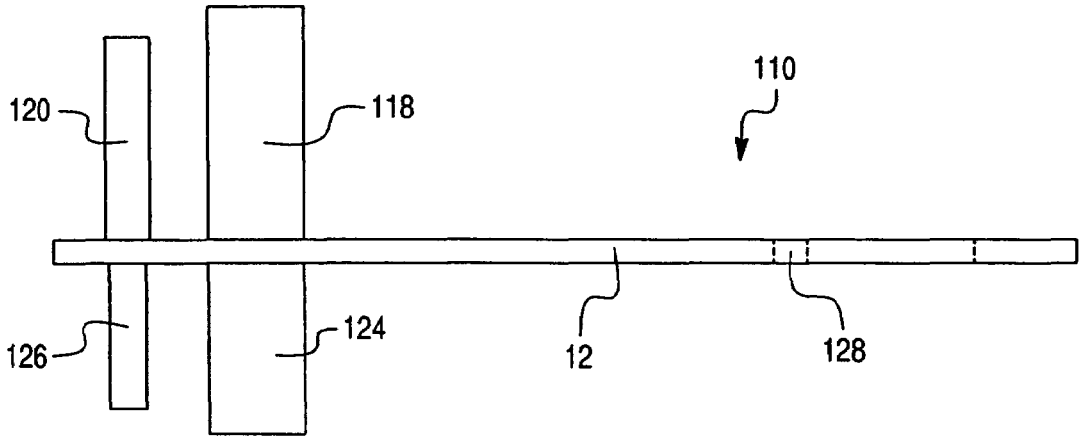
FIG. 11 is an elevational view of the second embodiment with portions shown in phantom.
Figure 12:
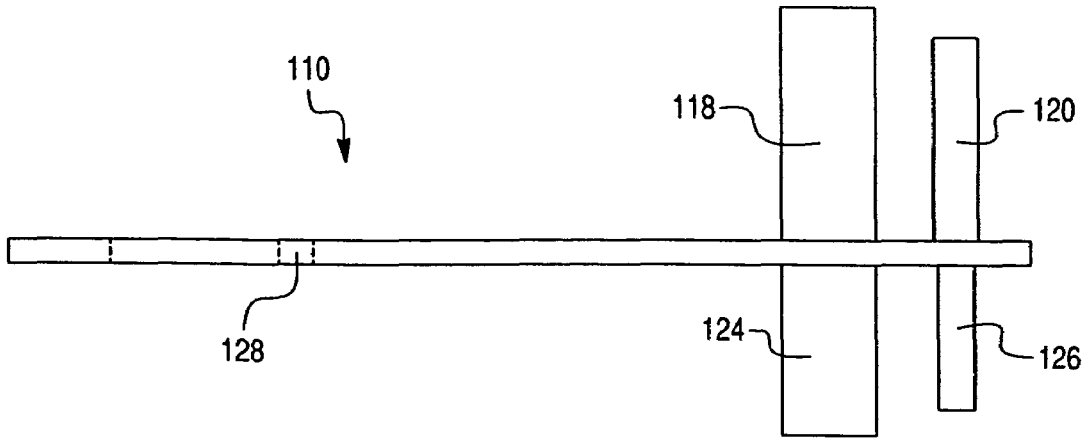
FIG. 12 is an elevational view of the second embodiment with portions shown in phantom.
Figure 13:
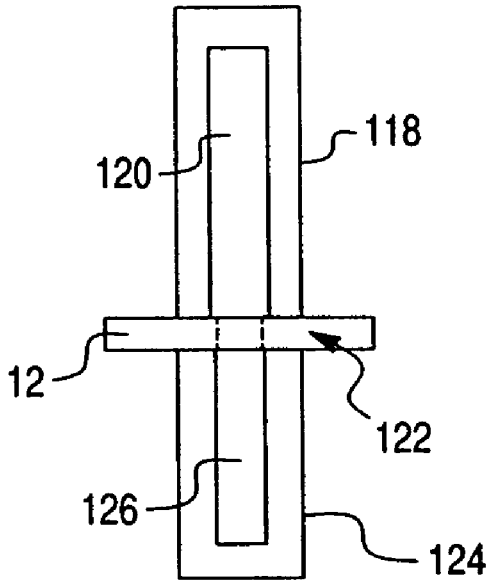
FIG. 13 is an end elevational view of the second embodiment with portions shown in phantom.
Figure 14:
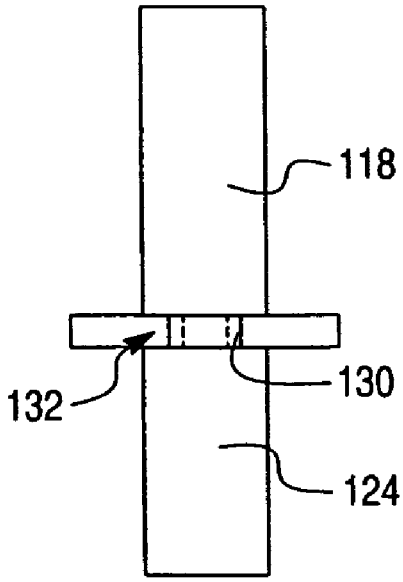
FIG. 14 is an end elevational view of the second embodiment with portions shown in phantom.

As best shown in FIG. 11, first anvil 118 has a length exceeding the length of adjacent hinge pin bit 120 and also has a diameter exceeding the hinge pin bit 120 diameter. Correspondingly, second anvil 124 has a length and a diameter exceeding the length and diameter of adjacent hinge pin bit 126. The hinge pin bit 120 has a length and diameter exceeding the length and diameter of hinge pin bit 126. Likewise, anvil 118 has a length and diameter exceeding the length and diameter of anvil 124. The materials comprising the tool 110 and the dimensions of tool body 112 and the slot 130 are essentially the same as described in the preferred embodiment. As also indicated above, the dimensions of the components in the alternate embodiment may be modified depending on the needs of the user. I include two anvils and hinge pin bits with tool 110 in order to accommodate a wider range of diameters of pintles.

The tool 110 disclosed in the alternate embodiment gives a user the option of selecting from two available bit sizes. Because the anvil 118 has a length exceeding the length of hinge pin bit 120, the likelihood of striking hinge pin bit 120 when hinge pin bit 126 is to be used to remove a pintle is substantially reduced. Correspondingly, again due to length differences, hinge pin bit 126 is not likely to be damaged when anvil 124 is struck with a hammer during use of hinge pin bit 120. The length differences thus permit maximum striking force to be applied to the anvil, while minimizing the possibility of damaging the adjacent hinge pin bit. Additionally, the design of the tool 110 disclosed in the alternate embodiment includes anvils 118, 124 that are spaced away from the end of the tool 110 that includes the hinge pin bits 120, 126. This design gives a user an additional margin of safety to prevent damage to the walls or woodwork associated with the hinge in the event that the hammer skips or glances off the anvil 118, 124 during the pin removal process.

In operation, the tool 110 functions similarly to tool 10. As best shown in FIGS. 8–14, a user positions the first 120 or second 126 hinge pin bit adjacent to a door hinge pin. If the hinge pin cannot be removed by manually applying pressure directly to the hinge pin with the tool 110, a hammer or other blunt object is used to strike either the first 118 or second 124 anvil on the anvil's planar striking surface 119, 125. The force from the hammer is communicated through the anvil 118, 124 to the hinge pin bit 120, 126. The hinge pin bit 120, 126 forces the door hinge pin to move, usually upwardly, within the door hinge knuckles. The user may then position the head of the hinge pin within the channel 130 at the second end 132 of the tool 110, and apply pressure to force the hinge pin out of the knuckles of the door hinge. As noted above, the tool disclosed in the alternate embodiment may also be used for other functions associated with the installation and removal of a door.

For the foregoing reasons it is clear that the invention provides an efficient and effective tool for removing door hinge pins and adjusting door hinges. The current invention may be modified and customized as required. Although the materials of construction are generally described, they may include a variety of compositions consistent with the functions of the invention.

It is understood that while various preferred designs have been used to describe this invention, the invention is not limited to the illustrated and described features. Modifications, usages and/or adaptations following the general principles disclosed herein are included in the present invention, including such departures that come within known or customary practice in the art to which this invention pertains. The present invention is intended to encompass all such departures having the central features set forth above, without departing from the scope and spirit of the invention, and which fall within the scope of the appended claims.

I claim:

1. A hinge pin removal and adjustment tool, comprising:

a body having a planar first side and an oppositely disposed planar second side, said body having a first end and an oppositely disposed second end, an elongated cylindrical anvil projecting perpendicularly from said first side and having a planar striking surface, a hinge pin bit extending perpendicularly to said second side parallel to said anvil, and a slot extending through said body from said first side to said second side, and extending from said first end toward said second end, wherein striking said striking surface causes said hinge pin bit to impart a force to a hinge pin for dislodging the hinge pin from a door hinge;

wherein said anvil is coaxial with said hinge pin bit and wherein said bit extends further from said body than said anvil extends from said body and wherein said bit has a diameter less than the diameter of said anvil.

2. The tool of claim 1 wherein said body has an elongate shape with rounded ends.

3. The tool of claim 1 wherein said anvil and said hinge pin bit are spaced from said first end.

4. The tool of claim 3 wherein said slot has a rounded first end and an open second end.

5. The tool of claim 1 wherein said slot is wider than a diameter of said hinge pin bit and narrower than a diameter of said anvil.

6. The tool of claim 1 wherein said hinge pin bit and said anvil are welded to said body.

7. The tool of claim 1 wherein an aperture extends through said body intermediate said slot and said anvil.

8. The tool of claim 1 wherein said anvil extends from said body a greater distance than a thickness of said tool.

9. The tool of claim 1 wherein said anvil and said hinge pin bit are adjacent to said first end.

10. The tool of claim 1 wherein said tool is comprised of a rigid material.

11. The tool of claim 10 wherein said tool is comprised of metal.

12. The tool of claim 11 wherein said tool is comprised of one of tempered or cold roll steel.

13. The tool of claim 1 wherein said tool is comprised of tempered and cold roll steel.

14. A hinge pin removal and adjustment tool, comprising:

a body having a planar first side and an oppositely disposed planar second side, said body having a first end and an oppositely disposed second end, a first elongated anvil projecting perpendicularly from said first side, a first hinge pin bit spaced from said anvil and extending perpendicularly from said first side, said first hinge pin bit having a length that is at least the length of said first anvil, a second elongated anvil projecting perpendicular to said second side, said second anvil being coaxial with said first anvil, a second hinge pin bit extending perpendicularly from said second side and being coaxial with said first hinge pin bit, said second hinge pin bit having a diameter less than the diameter of said first hinge pin bit.

15. The tool of claim 14 wherein said first hinge pin bit has a length less than the length of said first anvil.

16. The tool of claim 15 wherein said first hinge pin bit has a diameter less than the diameter of said first anvil.

17. The tool of claim 16 wherein said second hinge pin bit has a length less than the length of said second anvil and said second hinge pin bit has a diameter less than the diameter of said second anvil.

18. The tool of claim 17, wherein said first anvil has a length exceeding the length of said second anvil.

19. The tool of claim 18, wherein said first hinge pin bit has a diameter exceeding the diameter of said second hinge pin bit.

20. A hinge pin removal and adjustment tool, comprising:

a body having a planar first side and an oppositely disposed planar second side, said body having a first end and an oppositely disposed second end, an elongated cylindrical anvil projecting perpendicularly from said first side and having a planar striking surface, a hinge pin bit extending perpendicularly to said second side parallel to said anvil, and a slot extending through said body from said first side to said second side, and extending from said first end toward said second end, wherein striking said striking surface causes said hinge pin bit to impart a force to a hinge pin for dislodging the hinge pin from a door hinge, wherein said slot is wider than a diameter of said hinge pin bit and narrower than a diameter of said anvil.

* * * * *